US005994017A

United States Patent [19]

Lin

[11] Patent Number: 5,994,017

[45] Date of Patent: Nov. 30, 1999

[54] TONER AND DEVELOPER COMPOSITIONS WITH COMPATIBILIZERS

[75] Inventor: Pinyen Lin, Rochester, N.Y.

[73] Assignee: Xerox Corporation, Stamford, Conn.

[21] Appl. No.: 09/259,448

[22] Filed: Mar. 1, 1999

[51] Int. Cl.[6] ..... G03G 9/097

[52] U.S. Cl. ..... 430/110; 430/137

[58] Field of Search ..... 430/110, 137

[56] References Cited

U.S. PATENT DOCUMENTS

| | | | |
|---|---|---|---|
| 4,367,275 | 1/1983 | Aoki et al. | 430/99 |
| 4,557,991 | 12/1985 | Takagiwa et al. | 430/109 |
| 4,795,689 | 1/1989 | Matsubara et al. | 430/99 |
| 4,997,739 | 3/1991 | Tomono et al. | 430/110 |
| 5,229,242 | 7/1993 | Mahabadi et al. | 430/106.6 |
| 5,486,445 | 1/1996 | Van Dusen et al. | 430/110 |

*Primary Examiner*—Roland Martin
*Attorney, Agent, or Firm*—E. O. Palazzo

[57] ABSTRACT

A toner composition comprised of resin, colorant, wax, and an acrylatealkylene polymer compatibilizer.

27 Claims, No Drawings

TONER AND DEVELOPER COMPOSITIONS WITH COMPATIBILIZERS

BACKGROUND OF THE INVENTION

This invention is generally directed to toner and developer compositions, and more specifically, the present invention is directed to toner compositions, including magnetic, single component, two component and colored toner compositions containing a compatibilizer of, for example, a butyl acrylate/ethylene copolymer primarily for wax component dispersion enhancement, and wherein excellent jetting characteristics are enabled. In embodiments of the present invention, the toner compositions can contain at least two polymers, and in embodiments from about 2 to about 10 polymers comprised, for example, of a first polymer, a second crosslinked polymer or resin, a wax component, and a compatibilizer component. More specifically, in embodiments of the present invention, the toner compositions are comprised of resin particles, especially crosslinked extruded polyester resin particles, colorant particles, a wax component, such as polypropylene wax, and a compatibilizer. There is also provided in accordance with the present invention positively or negatively charged toner compositions comprised of resin particles, colorant particles, a wax component, such as a polypropylene wax, compatibilizer, and a charge enhancing additive. In addition, the present invention is directed to developer compositions comprised of the aforementioned toners, and carrier particles. Furthermore, in another embodiment of the present invention there are provided single component toner compositions comprised of resin particles, magnetic components, such as magnetites, a wax component, such as polypropylene wax, and a compatibilizer. The toner and developer compositions of the present invention are useful in a number of known electrostatographic imaging and printing systems, especially those systems wherein a wax is present in the toner.

The toner compositions of the present invention, in embodiments, possess a wide fusing latitude of, for example about 100° C., which latitude is the temperature range between the minimum toner fixing temperature of, for example, from about 100° C. to about 170°0 C. (Centigrade) of importance for fixing toner particles on paper, and the hot offset temperature, for example from about 180° C. to about 250° C., which is the temperature where molten toner adheres to the fuser roll. The developer compositions of the present invention also can provide toner images with low surface energy and a low frictional coefficient, which properties enable the effective release of paper from a fuser roll and provide for a reduction in image smudging. Further, the toner compositions of the present invention possess stable electrical properties for extended time periods, and with these compositions there is, for example, no substantial change in the triboelectrical charging values. Also, with the toner compositions of the present invention, the wax, which enhances toner release from a fuser roll and increases fusing latitude, is retained therein, and the loss of wax from the toner is eliminated or minimized; and moreover, the toner compositions of the present invention with stabilized wax domains are more easily processed by extrusion, and are easily and superiorly jetted which allows for more rapid toner production and lower toner manufacturing costs. The control of wax concentration also enables the economy of direct recycling of toner fines obtained after particle size classification, which fines would ordinarily be discarded as waste material. The dispersion stabilization of wax by compatibilizers also decreases the minimum fusing and release temperature, thereby improving toner fusing latitude.

PRIOR ART

Illustrated in U.S. Pat. No. 5,843,612, the disclosure of which is totally incorporated herein by reference, is a toner composition comprised of resin, colorant, wax, and a compatibilizer of the formula $$A_{(a)}—B_{(b)}—C_{(c)}—D_{(d)}-$$

wherein A is ethylene, B is propylene, C is butene, and D is pentene, and wherein the mole fractions are represented by a, b, c, and d, and wherein a is from about 0.05 to about 0.95, b is from about 0.05 to about 0.95, c is from about 0.05 to about 0.95, and d is from about 0.05 to about 0.95, and subject to the provision that the sum of a, b, c, and d are equal to about 1. Disadvantages that may be associated with the toners of this application are that the toner may possess adverse flow characteristics in the absence of flow additives. The toner, which can be tested using a Hosokawa tester, possess, for example, a toner flow index of 90 percent whereas the invention toner possesses, for example, a toner flow index of 60 percent. Insufficient toner powder flow of 90 percent results in deteriorating developer flow in the developer housing and subsequently insufficient toner development on the substrate.

The following United States Patents are mentioned: 4,795,689 which discloses a toner comprising a nonlinear polymer, a low melting polymer, which is incompatible with the nonlinear polymer, a copolymer, which is compatible with a nonlinear polymer, and a segment polymer, which is at least compatible with the low melting polymer, and a coloring agent, see the Abstract, and columns 3 to 10 for example; U.S. Pat. No. 4,557,991 which discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25; and as collateral interest U.S. Pat. No. 3,965,021.

Developer and toner compositions with certain waxes therein, which waxes can be selected as a component for the toners of the present invention, are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax ($M_w$: from about 200 to about 6,000) to improve hot offset. In addition, a number of patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045, three component toner compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to the acids; mono and polyhydric alcohol esters of the acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images to a fuser roll, and wherein the toner can subsequently offset to supporting substrates such as papers.

Illustrated in U.S. Pat. No. 5,229,242, the disclosure of which is totally incorporated herein by reference, are toner compositions comprised of resin particles, pigment particles inclusive of magnetites, waxes, and for example certain compatibilizers. More specifically, this patent discloses toner compositions comprised of first resin particles, second crosslinked resin particles, pigment particles, low molecular weight waxes, such as polyethylene, and polypropylene, such as those available from Sanyo Chemicals of Japan as VISCOL 550™ and VISCOL 660™ and the like, and as a compatibilizer a block or graft copolymer. Examples of compatibilizers illustrated in this patent include block or graft copolymers of the structure A-(block)-B, A-b-B-b-A or A-(graft)-B with the polymeric segments A and B each being compatible with a different polymer thereby permitting the compatibilizer to serve, for example, as a macromolecular surfactant. Examples of compatibilizers include block copolymers, such as the KRATON® copolymers, available from Shell Chemical Company, and STEREON® copolymers, available from Firestone Tire and Rubber Company. For example, KRATON G1701X®, a block copolymer of styrene-ethylene/propylene, KRATON G1726®, a block copolymer of styrene-ethylene/butylene-styrene, KRATON G1652®, a block copolymer of styrene-ethylene/butylene-styrene, STEREON 730A®, a block copolymer of styrene and butadiene, and the like. With KRATON G1701® the A segment could be the styrene block and the B segment could be an ethylene/propylene block. In embodiments of this patent, there are provided toners wherein the compatibilizer is of the formula A-b-B, A-b-B or A-g-B wherein A-b-B is a block copolymer of 2 segments, A and B, A-b-B-b-A is a block copolymer of 3 segments, A, B and A, and A-g-B is a graft copolymer of segments A and B, wherein the polymeric segment A is identical or compatible to one of the components present in the toner composition, that is, the toner resin, whereas the polymeric segment B is identical or compatible with the other polymer component in the toner composition, that is, for example, the wax. Thus, in embodiments of the U.S. Pat. No. 5,229,242, the aforementioned compatibilizer can be comprised of rigid units, such as styrene, with the polymeric segment B being comprised of flexible, rubber-like units such as ethylene/propylene. The molecular weight of polymeric segment A can be from about 3,000 to about 100,000, and the molecular weight of polymeric segment B can be from about 5,000 to about 200,000.

Although the toners of U.S. Pat. No. 5,229,242 function for their intended purposes, improved wax compatibilizer compositions have been developed after extensive research and many failures. Toners with the compatibilizer of the present invention enable improved extruder mixing and processing, superior toner jetting rate, improved wax dispersions, and improved fusing properties at reduced cost. The wax compatibilizers of U.S. Pat. No. 5,229,242 are considered, it is believed, thermoplastic elastomers, which indicates a material that at room temperature (25°C.) can be stretched repeatedly at least twice its original length and upon immediate release of the stress will return with force to its original approximate length. Although the elastomeric materials in U.S. Pat. No. 5,229,242 compatibilize the wax, when they possess a high-molecular weight they may also impart toughness and poor processing characteristics, such as poor toner jettability to the toner composite. Moreover, these commercially available elastomeric materials are often mixtures of diblock and triblock copolymers which can possess counter-productive properties in toner applications. Further, the commercially available resins of U.S. Pat. No. 5,229,242, when present in the toner between 2 and 5 weight percent, can sometimes adversely affect toner fusing and toner jetting rates.

Illustrated in U.S. Pat. No. 5,486,445, the disclosure of which is totally incorporated herein by reference, is, for example, a toner composition comprised of resin particles, pigment particles, wax component particles, and a compatibilizer comprised of a diblock polymer of hydrogenated polystyrene/polyisoprene or polystyrene/polybutadiene, with isoprene/ethylene/isopentene/vinylbutene/vinyl-2-methylbutene groups or isoprene/ethylenelbutene/and vinylbutene groups, and wherein the wax and diblock form domains of an average particle diameter of from about 0.1 to about 2 microns. However, the aforementioned diblock and triblock copolymers usually possess higher melt viscosity as compared to the toner resins and wax component at melt mixing temperatures. The mismatched viscosity can in some instances require a higher mixing energy and higher mixing intensity to achieve the uniformity of the wax and pigment distribution. Furthermore, the residual double bonds in the polyisoprene or polybutadiene portion are not believed to be thermally stable and can be reactive to other components in the toner at elevated temperatures. This could increase the melt rheology of the toner and change the fusing characteristics. In contrast, the acrylate/ethylene copolymers of the present invention possess a low melt viscosity, a higher polymer chain mobility and a more favorable match of the viscosity with the polymer in the toner. These advantages significantly reduce the melt mixing energy and permit improved wax and pigment dispersion. Moreover, with improved melt mixing, the amount of compatibilizers selected can be reduced to achieve the same level of wax dispersion, the jetting speed of the toner can be increased, and the minimum toner fusing temperature can be decreased. The invention compatibilizers polymers are thermally stable primarily because of the absence of residual double bonds, and possess low toner flow index, for example less than about 60 percent, without any surface additives, that is, the toner powder flow is improved as compared to toners with other compatibilizers.

There are various problems associated with the inclusion of polyolefins or other waxes in toners. For example, when a polypropylene wax is included in a toner to enhance the release of toner from a hot fuser roll, or to improve the lubrication of fixed toner image it has been observed that the wax does not disperse well in the toner resin. As a result, free wax particles are released during the pulverizing/jetting, or micronization step in, for example, a fluid energy mill and the pulverization rate is lower. The poor dispersion of wax in the toner resin and, therefore, the loss of wax will then impair the release function. Scratch marks, for example, on xerographic developed toner solid areas caused by stripper fingers were observed as a result of poor release. Furthermore, free wax remaining in the developer will build up on the detone roll present in the xerographic apparatus causing a hardware failure.

The aforementioned problems, and others can be eliminated, or minimized with the toner compositions and processes of the present invention in embodiments thereof. The release of wax particles is, for example, a result of poor wax dispersion during the toner mechanical blending step. The toner additives should be substantilly completely dispersed in the primary toner resin. For some of the additives, such as waxes like polypropylene, available as VISCOL 550P™ that become a separate molten phase during melt mixing, the difference in viscosity between the wax and the resin can be orders of magnitude apart, thus causing difficulty in reducing the wax phase domain size. A more fundamental reason for poor dispersion is due to the inherent thermodynamic incompatibility between polymers. The Flory-Huggins interaction parameter between the resin and the wax is usually positive (repulsive) and large so that the interfacial energy remains very large in favor of phase separation into large domains to reduce the interfacial area. Some degree of success has been obtained by mechanical blending the toner formulation in certain types of mixers, such as the known Banbury mixer, where the temperature of melt can be maintained at a low level and the polymer viscosities are similar. However, it has been found difficult to generate an effective wax dispersion in compounding extruders where melt temperatures are typically higher. The inclusion of a compatibilizer of the present invention is designed to overcome the inherent incompatibility between different polymers, and, more specifically, between toner resin and wax, thus widening the processing temperature latitude and enabling toner preparation in a large variety of equipment, inclusive of an extruder. The improvement in thermodynamic compatibility can also provide for a more stable dispersion of a secondary polymer phase, such as wax, in the host resin against gross phase separation over time. The use of commercially available dispersants like Kraton G-1726 or D-1118 contain triblock copolymers and high molecular weight components do not, it is believed, substantially assist the thermodynamic stability and do not, it is believed, act as rubbery regions in the toner bulk. The elastic regions tend to create ductile fracture points and thereby reduce the jetting rate, and therefore, contribute to increased cost of powder processing.

The toners of the present invention are effectively jettable it is believed because the specific polymers added as wax compatibilizers disperse the wax into domains of a size less than for, example, 2 microns without toughening the toner composite of wax, wax dispersant, colorant, charge control agent and colorant. Moreover, the specific copolymers of the present invention are friable powders which enable better mixing of the toner components by extrusion processes.

A number of specific advantages are associated with the invention of the present application in embodiments thereof, including improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by free wax particles; avoiding the pulverizing rate reduction resulting from the poor wax dispersion; maintaining the intended concentration of wax in the toner to provide enhanced release of toner images from the fuser roll and the avoidance of the undesirable scratch marks caused by the stripper fingers needed for paper management; a wide process latitude during the mechanical blending operation of the toner manufacturing process; and the effective mechanical blending of toner in a number of devices, including an extruder.

SUMMARY OF THE INVENTION

It is a feature of the present invention to provide toner and developer compositions which possess many of the advantages indicated herein.

Another feature of the present invention resides in the provision of toner and developer compositions with stable triboelectrical characteristics for extended time periods.

In another feature of the present invention there are provided toner and developer compositions with excellent jetting rates and which toners enable improved dispersion of resin and wax components in a number of devices, including an extruder.

Another feature of the present invention relates to the provision of toner and developer compositions with acrylate/ethylene copolymers, and wherein for the resulting toners there is avoided, or there is minimized, the undesirable generation of particles comprised entirely of a secondary polymer component during toner preparation.

In a further feature of the present invention the toner mechanical blending operation can be accomplished at a melt temperature as high as 50° C. above the melting point of the wax component, thus enabling the use of a large number of apparatuses in addition to a low melt temperature mixing process using equipment, such as a Banbury mixer, and wherein the toners are easily jettable.

In yet another feature of the present invention the secondary polymeric phases in the toner will remain stable and substantial phase separation, especially over extended time periods of, for example, up to three months in embodiments, can be avoided.

Another feature of the present invention provides acrylate/ethylene copolymers of specific compositions which will enable reductions in the minimum fusing temperature of the resulting toners, including toner resins of polyesters with polyolefin waxes.

In yet another feature of the present invention there is provided a toner with acrylate/ethylene copolymers which toner possesses superior toner powder flow properties. The toner flow properties enable for example a stable developer flow in the developer housing and consequently the toner development meets the required solid area density.

Additionally, in yet another feature of the present invention there are provided toner and developer compositions with certain waxes therein or thereon that enable images of excellent quality inclusive of acceptable resolutions, and that possess other advantages as illustrated herein such as low surface energy and excellent jetting rates.

Yet another feature of the present invention resides in the provision of processes for the preparation of toner compositions wherein the undesirable escape of the wax contained therein is avoided or minimized.

These and other features of the present invention can be accomplished in embodiments by providing toner and developer compositions. Aspects of the present invention relate to a toner composition comprised of resin, colorant, wax, and an acrylate/alkylene compatibilizer; a toner wherein the colorant is a pigment; a toner wherein the alkylene possesses from about 50 to about 2,000 carbon atoms; a toner wherein the alkylene possesses from about 100 to about 1,000 carbon atoms; a toner wherein the alkylene is ethylene, propylene, butylene, and the like; a toner wherein the weight average molecular weight, $M_w$, of the compatibilizer is from about 10,000 to about 160,000; a toner wherein the weight average molecular weight, $M_w$, of the compatibilizer is from about 20,000 to about 60,000; a toner wherein the compatibilizer is an ethylene/butyl acrylate copolymer, an ethylene/methyl acrylate copolymer, an ethylene/methyl methacrylate copolymer, or an ethylenelbutyl methacrylate copolymer; a toner further containing a second crosslinked resin; a toner wherein the crosslinked resin is a styrene acrylate, or a styrene methacrylate; a toner composition wherein the wax and the compatibilizer together form domains of an average particle diameter of from about 0.1 to about 3 microns; a toner composition wherein the compatibilizer is present in an amount of from about 0.5 to about 10 weight percent; a toner composition wherein the compatibilizer is present in an amount of from about 1 to about 5 percent; a toner composition wherein the resin particles are selected from the group consisting of polyesters, styrene butadiene copolymers, styrene diene copolymers, styrene polyolefin copolymers, styrene acrylate copolymers, and styrene methacrylate copolymers; a toner composition wherein the polyester results from the condensation reaction of dimethylterephthalate, 1,2-propanediol, 1,3-butanediol, and pentaerythritol; or wherein the polyester results from the condensation reaction of proxylated-bisphenol A, dimethylterephthalate, 1,2-propanediol, diethylene glycol, and pentaerythritol; a toner composition wherein the first resin particles are present in an amount of from about 40 to about 90 weight percent, and the second resin particles are present in an amount of from about 60 to about 10 weight percent; a toner composition wherein the first resin particles are comprised of styrene butadiene, styrene acrylate, or styrene methacrylate, and wherein the second crosslinked resin particles are comprised of a crosslinked polymer of styrene butadiene, styrene acrylate, or styrene methacrylate, wherein the first resin is present in an amount of from about 50 weight percent to about 85 weight percent, and the second resin is present in an amount of from about 10 weight percent to about 40 weight percent; a toner composition wherein the colorant is the pigment carbon black, magnetite, magenta, cyan, yellow, or mixtures thereof; a toner composition wherein the wax has a weight average molecular weight of from about 1,000 to about 20,000, wherein the wax is a polyolefin, or mixture of polyolefins, and wherein the wax is present in an amount of from about 1 to about 10 weight percent, and which toner further contains a charge enhancing additive selected, for example, from the group consisting of distearyl dimethyl ammonium methyl sulfate, a cetyl pyridinium halide, and stearyl phenethyl dimethyl ammonium tosylate, and wherein the polyolefin is polyethylene or polypropylene; a method for obtaining images which comprises generating an electrostatic latent image on a photoconductive imaging member, subsequently affecting development of this image with the toner composition illustrated herein, thereafter transferring the image to a permanent substrate, and optionally permanently affixing the image thereto; a process for minimizing the amount of wax that escapes from a toner, which comprises melt mixing toner resin, colorant, a wax component, and an acrylate/alkylene polymer such as a butylacrylate/alkylene polymer compatibilizer; a process for minimizing the amount of wax that escapes from a toner which comprises melt mixing toner resin, colorant, a wax component, and an acrylate/alkylene polymer such as a butylacrylate/ethylene copolymer compatibilizer; and a toner composition comprised of resin particles, colorants, such as pigment particles inclusive of magnetites, waxes, and as compatibilizer an acrylate/alkylene, especially an ethylene polymer. In embodiments of the present invention, there are provided toner compositions comprised of first resin particles, second crosslinked resin particles, colorant especially pigment particles, low molecular weight waxes, such as polyethylene, and polypropylene, such as those available from Sanyo Chemicals of Japan as VISCOL 550P™ and VISCOL $_{660}$P™, Mitsui "Hi-wax" NP055 and NP105, or wax blends such as MicroPowders, Micropro-440 and 440w, and the like, and as a compatibilizer an acrylate/alkylene, especially ethylene polymer. Furthermore, there are provided in accordance with the present invention positively charged toner compositions comprised of resin particles, colorant particles, low molecular weight waxes, an acrylate/alkylene, especially ethylene polymer compatibilizer, and a charge enhancing additive. Another embodiment of the present invention is directed to developer compositions comprised of the aforementioned toners; and carrier particles.

In accordance with embodiments of the present invention, there are also provided developer compositions comprised of toner compositions containing first resin particles like a styrene butadiene resin, polyesters, optional second crosslinked resins of, for example, a styrene methacrylate crosslinked with known components such as divinylbenzene, colorant, such as pigment particles, such as MAPICO BLACK®, magnetites, carbon blacks or mixtures thereof, low molecular weight waxes, such as polyethylene, and polypropylene, such as those available from Sanyo Chemicals of Japan as VISCOL 550P™ and VISCOL 660P™, or Mitsui "Hi-wax" NP055 and NP105, or wax blends (for example the toner can have a wax content up to about 15 percent by weight, and more specifically, from about 0.05 to about 6 weight percent, or from about 0.05 to about 6 weight percent), such as MicroPowders, Micropro-440 and 440w, a compatibilizer comprised of an acrylate/alkylene, especially ethylene polymer and an optional charge enhancing additive, particularly, for example, distearyl dimethyl ammonium methyl sulfate, reference U.S. Pat. No. 4,560,635, the disclosure of which is totally incorporated herein by reference, and carrier particles. As carrier components for the aforementioned compositions, there can be selected a number of known materials like steel, iron, or ferrite, particularly with a polymeric coating thereover including copolymers of vinyl chloride and trifluorochloroethylene with conductive substances dispersed in the polymeric coating inclusive of, for example, carbon black.

Examples of alkylene/acrylate polymers, are ethylene polymers, such as ethylene-butyl acrylate copolymers, and ethylene-methyl acrylate copolymers. The acrylate content of the copolymer is, for example, from about 3 percent by mole to about 40 percent by mole, and preferably from about 5 percent by mole to about 30 percent by mole. The molecular weight of the ethylene/acrylate copolymers is, for example, from about 10,000 to about 160,000, and preferably from about 20,000 to about 60,000. Specific examples of alkylene/acrylate copolymers include LOTRYL® EMA and LOTRYL® BMA, available from Elf Atochem North America, Inc., Philadelphia, Pa. The weight average molecular weight, $M_w$, of the compatibilizer is, for example, from about 20,000 to about 60,000, and wherein the wax and the compatibilizer together form domains of, for example, an average particle diameter of from about 0.1 to about 1.5 microns.

Illustrative examples of suitable toner resins or polymers selected for the toner and developer compositions of the present invention, and present in various effective amounts, such as, for example, from about 65 percent by weight to about 95 percent by weight, include styrene acrylates, styrene methacrylates, styrene butadienes, styrene isoprenes, polyesters, polyamides, epoxy resins, polyurethanes, polyolefins, vinyl resins, polymeric esterification products of a dicarboxylic acid and a diol comprising a diphenol; crosslinked resins; and mixtures thereof. Various suitable vinyl resins may be selected as the toner resin including homopolymers or copolymers of two or more vinyl monomers. Typical vinyl monomeric units include styrene, p-chlorostyrene, vinyl naphthalene, unsaturated monoolefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. The styrene butadiene copolymers, especially styrene butadiene copolymers prepared by a suspension polymerization process, reference U.S. Pat. No. 4,558,108, the disclosure of which is totally incorporated herein by reference, can be selected as the toner resin in embodiments.

As one toner resin, there can be selected the esterification products of a dicarboxylic acid and a diol comprising a diphenol, which components are illustrated in U.S. Pat. No. 3,590,000, the disclosure of which is totally incorporated herein by reference. Other toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES® and PLIOTONES® obtained from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol. In embodiments, the toner is comprised of a mixture of resins comprised, for example, of a first resin as illustrated herein like styrene acrylate, styrene methacrylate, or styrene butadiene with a high styrene content, and a second polymer comprised of a crosslinked copolymer of styrene and butyl methacrylate. The aforementioned mixture of first and second resins can contain various effective amounts of each resin, for example from about 50 to about 90, and preferably about 70 weight percent of the first resin like styrene butadiene, and from about 50 to about 10, and preferably about 30 weight percent of the second resin like the resin crosslinked with, for example, divinylbenzene. Preferred toner resin includes the extruded polyesters of U.S. Pat. Nos. 5,376,494 and 5,227,460, the disclosures of which are totally incorporated herein by reference.

Numerous well known suitable colorants, especially pigments, can be selected as the colorant for the toner particles including, for example, carbon black, like REGAL330®, BLACK PEARLS®, VULCAN®, and the like, cyan, magenta, yellow, blue, red, green, orange, nigrosine dye, food dyes, aniline blue, phthalocyanine derivatives, magnetites and mixtures thereof. The colorant, which is preferably carbon black, should be present in a sufficient amount to render the toner composition colored thereby permitting the formation of a clearly visible image. Generally, the colorant particles are present in amounts of from about 1 percent by weight to about 20 percent by weight, and preferably from about 4 to about 10 weight percent, based on the total weight of the toner composition, however, lesser or greater amounts of colorant particles may be selected in embodiments.

When the colorant particles are comprised of known magnetites, including those commercially available as MAPICO BLACK®, they are usually present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

There are also provided colored toner compositions containing dyes, or pigments, known magenta, cyan, and/or yellow particles, and mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as Cl 60710, Cl Dispersed Red 15, a diazo dye identified in the Color Index as Cl 26050, Cl Solvent Red 10, Lithol Scarlett, Hostaperm, and the like. Illustrative examples of cyan materials include copper tetra-4(octadecyl sulfonamido) phthalocyanine, copper phthalocyanine pigment listed in the Color Index as Cl 74160, Cl Pigment Blue, and Anthrathrene Blue, identified in the Color Index as Cl 69810, Special Blue X-2137, Sudan Blue, and the like; while illustrative examples of yellows include diarylide yellow 3,3-dichlorobenzidene acetoacetanilides, a monazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Permanent Yellow FGL, food dyes, and the like. Also, there may be selected red, green, blue, brown, and the like pigments. These pigments are generally present in the toner composition in an amount of from about 2 weight percent to about 15 weight percent, and preferably from about 2 to about 10 weight percent, based on the weight of the toner resin particles.

Colorant includes pigments, dyes, mixtures thereof, mixtures of pigments, mixtures of dyes, and the like to primarily impart color to the toner.

Examples of low molecular weight, for example from about 1,000 to about 20,000, and preferably from about 1,000 to about 7,000, waxes include those as illustrated in British Patent Publication 1,442,835, such as polyethylene, polypropylene, and the like, especially VISCOL 550P™ and VISCOL $_{660}$P™. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion have a lower pulverizing rate and the free wax which can remain with the toner will build up on the internal parts of the xerographic cleaning device causing a machine failure.

Illustrative examples of optional charge enhancing additives present in various effective amounts, such as for example from about 0.1 to about 20, and preferably from 1 to about 5 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; negative charge control agents, such as di-t-butylaluminum salicylate, Alohas or BONTRON E88® (available from Orient), E-88® (available from Hodogaya), tetraphenyl phosphonium tetrafluoroborate, and other known similar charge enhancing athetives; and the like.

With further respect to the toner and developer compositions of the present invention, a component that may be present therein is a linear polymeric alcohol comprised of a fully saturated hydrocarbon backbone with at least about 80 percent of the polymeric chains terminated at one chain end with a hydroxyl group, which alcohol is represented by the following formula $$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in an embodiment of the present invention the polymeric alcohols selected have a number average molecular weight as determined by gas chromatography of from about greater than 450 to about 1,400, and preferably of from about 475 to about 750. In addition, the aforementioned polymeric alcohols can be present in the toner and developer compositions illustrated herein in various effective amounts, and can be added as uniformly dispersed internal, or as finely divided uniformly dispersed external additives. More specifically, the polymeric alcohols can be present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes and compatibilizer present internally are formulated by initially blending the toner resin particles, colorant particles, and polymeric alcohols, and other optional components. By contrast, when the polymeric alcohols are present as external additives, the toner composition is initially formulated and comprised of, for example, resin particles and pigment particles; and subsequently there are added thereto finely divided polymeric alcohols.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of known carrier particles that may be selected include granular zircon, granular silicon, glass, steel, nickel, iron, ferrites, like copper zinc ferrites, available from Steward Chemicals, and the like. The carrier particles may include thereon known coatings like fluoropolymers, such as KYNAR®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidene fluoride resins, poly(chlorotrifluoroethylene), fluorinated ethylene and propylene copolymers, terpolymers of styrene, methylmethacrylate, and a silane, such as triethoxy silane, reference U.S. Pat. No. 3,467,634 and 3,526,533, the disclosures of which are totally incorporated herein by reference; polytetrafluoroethylene, fluorine containing polyacrylates, and polymethacrylates; copolymers of vinyl chloride, trichlorofluoroethylene; and other known coatings. There can also be selected as carriers components comprised of a core with a mixture, especially two, polymer coatings thereover, reference U.S. Pat. No. 4,937,166 and 4,935,326, the disclosures of which are totally incorporated herein by reference. Examples of carrier particles disclosed in the aforementioned patents can be prepared by (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 30 microns to about 1,000 microns, and preferably from about 50 to about 200 microns, thus allowing these particles to possess sufficient density and inertia to avoid adherence to the electrostatic images during the development process. The carrier particles can be mixed with the toner particles in various suitable combinations, such as from about 1 to about 8 parts per toner to about 100 parts to about 200 parts by weight of carrier.

The toner compositions of the present invention can be prepared by a number of known methods, including mechanical blending and melt blending the toner resin particles, pigment particles or colorants, compatibilizer, optional additives, and polymeric waxes followed by mechanical attrition including classification. Other methods include those well known in the art such as spray drying, mechanical dispersion, melt dispersion, dispersion polymerization, and suspension polymerization. The toner particles are usually pulverized, and classified, thereby providing a toner with an average volume particle diameter of from about 7 to about 25, and preferably from about 10 to about 15 microns as determined by a Coulter Counter. The toner compositions of the present invention are particularly suitable for preparation in a compounding extruder such as a orotating intermeshing twin screw extruder of the type supplied by the Werner & Pfleiderer Company of Ramsey, New Jersey. The inclusion of compatibilizer can improve the thermodynamic compatibility between the primary and the secondary polymer phases. As a result, the secondary polymer are dispersed into a smaller domain size with improved adhesion to the primary resin. The smaller domain size of typically less than or about equal to 2 microns, and better adhesion will then prevent the secondary polymer from separating into individual particles during the pulverization operation. Wax domain sizes preferred for optimum extrusion, jetting, and fusing and release function are from about 0.1 micron to about 2.0 microns in diameter. Domain sizes experienced without the use of a compatibilizer are typically about 0.5 to about 10 microns and generally have a broad size distribution. Furthermore, the compatibilizing action can be effected even at high melt temperatures, for example 500C above the melting point of the wax component, when mechanical blending is difficult because of vast differences in polymer and wax viscosities. This advantage increases the process latitude of the mechanical blending operation. The advantage of including a compatibilizer may not be limited to the mechanical blending process alone; thus, for example, improved dispersion and adhesion can be realized in other known preparation methods by using the toner compositions of the present invention. Also, high concentrations of a secondary polymer, such as wax, can be effectively dispersed in a toner by including an effective amount of compatibilizer. Jetting rates, especially for styrene-acrylate and polyester binder resins, are reduced by 50 percent to 80 percent as compared to toners with commercial triblock, or certain graft copolymers are used as compatibilizers. With diblocks described herein, the toner jetting rates can be maintained at 90 percent to 110 percent of that for the binder resin alone. Thus, there is a significant cost advantage realized from the processing time required for grinding and jetting operations in toner manufacture. The improvement in toner jetting rate with the compatibilizer copolymers of the instant invention can, for example, be between about 2 to about 3 times more rapid than with the toners of U.S. Pat. No. 5,229,242 or U.S. Pat. No. 5,486,445. This jetting rate advantage together with fewer toner fines results in more than a two-fold reduction in the final cost of the toner.

The toner and developer compositions of the present invention may be selected for use in developing images in electrostatographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. Nos. 4,265,990, the disclosure of which is totally incorporated herein by reference. Moreover, there can be selected as photoconductors hydrogenated amorphous silicon, and as photogenerating pigments squaraines, perylenes, hydroxygallium phthalocyanines, and the like.

The toner and developer compositions of the present invention can be particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone.

The following Examples are provided, wherein parts and percentages are by weight unless otherwise indicated.

TABLE 1

| | Alkylene/Acrylate Copolymers Containing Toners and Comparative Toners | | | | | | |
|---|---|---|---|---|---|---|---|
| Example | Alkylene/ Acrylate Copolymer (Percent) | [1]Toner Flow Index (Before /After Aging) | [2]Free Wax Particles (Percent) | [3]Wax Domain Size (Microns) | [4]Solid Area Density | [5]Relative Jetting Rate | Minimum Fusing (°F.) |
| I | 3 | 40/65 | 0.1 | 1.4 | 1.42 | 1.45 | 262 |
| II | 4 | 42/63 | [7]<0.1 | 1.1 | 1.41 | 1.38 | 258 |
| III | 4 | 47/65 | <0.1 | 1.3 | 1.40 | 1.41 | 263 |
| IV | 4 | 41/67 | 0.12 | 1.6 | 1.45 | 1.39 | 264 |
| COMP. I | 0 | 83/95 | 0.4 | 6.0 | 0.9 | 1.39 | 289 |
| COMP. II | 0 | 51/85 | 0.17 | 1.7 | 1.0 | 1.10 | 271 |

[1]Toner Flow Index was measured by the Hosokawa Powder Tester.
[2]Free Wax was measured by using a centrifugal density separation technique.
[3]Wax Domain Size was measured by TEM and image analysis.
[4]Solid Area Density was measured by an optical densitometer.
[5]Relative Jetting Rate was calculated from the yield of toner.
[6]Minimum Fusing was measured with Xerox Corporation 5028 fuser.
[7]<-not measurable; thus, no wax detected.

Smaller wax domain size converts to a lower toner flow index and less free wax particles.

Solid area density values refer to print quality; the higher the number, the better the image resolution.

EXAMPLE I

A polyester resin resulting from the reactive extrusion of bisphenol A, propylene oxide and fumaric acid, and benzoyl peroxide initiator were blended in a rotary tumble blender for 30 minutes. The resulting dry mixture was then fed into a Werner & Pfleiderer ZSK-30 twin screw extruder with a screw diameter of 30.7 millimeters and a length-to-diameter (UD) ratio of 37.2, at 10 pounds per hour using a loss-in-weight feeder. The crosslinking was accomplished in the extruder using the following process conditions: barrel temperature profile of 70/1401140/140/140/140/140° C., die head temperature of 140° C., screw speed of 100 revolutions per minute and average residence time of about three minutes. The extrudate melt, upon exiting from the strand die, was cooled in a water bath and pelletized. The product, which was a crosslinked polyester generated from the above reactants of bisphenol A, propylene oxide and fumaric acid, had an onset Tg of about 54° C. as measured by DSC, melt viscosity of about 40,000 poise at 100° C. and about 150 poise at 160° C. as measured at 10 radians per second, a gel content of about 27 weight percent and a mean microgel particle size of about 0.1 micron as determined by transmission electron microscopy.

Thereafter, there was prepared in an extrusion device, available as ZSK28 from Werner & Pfleiderer, a toner composition by adding thereto 87 percent by weight of the above-genereated crosslinked polyester resin containing from about 15 to about 40 weight percent gel content, 5 percent by weight of the polypropylene wax VISCOL 660P™, 3 weight percent of the compatibilizer LOTRYL® EMA 28BA175™; and 5 weight percent of REGAL 330® carbon black from Cabot Inc. LOTRYL® EMA 28BA175™, available from Elf Atochem North America, Inc. of Pa., and about 28 percent butyl acrylate and 72 percent of ethylene in the copolymer composition and with a molecular weight $M_w$ of about 20,000 to 45,000. The toner product was extruded at a rate of about 10 pounds per hour at about 150° C. The strands of melt mixed product exiting from the extruder were cooled by passing them through a water bath maintained at about 25° C. After air drying, the resulting toner was subjected to grinding in a Model 200AFG Alpine Fluid Bed Grinder to afford particles with a volume median diameter of from about 8 to about 12 microns as measured by a Coulter Counter. The 200AFG grinder was operated with a 3 to 4 millimeter nozzle at 100 psig pressure. The grinder wheel speed was set to obtain the desired particle size, 8 to 12 microns. Relative jetting rates were calculated from collection yields, and was normalized by the jetting rate of the Xerox 5090™ toner. The relative jetting rate for this toner was found to be 1.45.

Thereafter, the toner particles were classified in a Donaldson Model B classifier for the purpose of removing fine particles, that is those with a volume median diameter of less than about 4 microns. This toner (3 lb. load) was then blended with small-sized external additives such as 0.5 weight percent TS-530 a hydrophobic treated fumed silica, obtained from Cabot Corporation, at 2,740 rpm for about 2 minutes with an 80° F. jacket on a Henschel 10 L FM-10 blender.

The toner powder flow index of the resulting toner was about 40 using a Hosokawa Powder tester. The percent by weight of the free wax particles was determined to be about 0.1 percent by weight for this toner, using a centrifugal density separation technique. Wax domain size was estimated, from TEM photo analysis, to be on average 1.4 microns in diameter with a standard deviation of 0.5 micron. Wax diameters from similar comparative toners without the compatibilizer have a mean value of 6.0 microns with a standard deviation of 2.4 microns.

Subsequently, there was prepared a developer composition by admixing the above formulated toner composition mechanically blended at 72° F. at a 3 percent toner concentration, that is 3.0 parts by weight of toner per 100 parts by weight of carrier comprised of a steel core, 90 microns diameter, with a coating, 0.8 weight percent thereover, of a polyvinylidine fluoride and polymethyl methacrylate and wherein mixing was accomplished in a paint shaker for up to 60 minutes. The 60 minute paint-shaked toner showed only a small increase in percent cohesion from about 40 to about 65. A toner powder index of less than about 75 is preferably desired for satisfactory development in a xerographic application. Thereafter, the formulated developer composition was incorporated into an electrostatographic imaging device with a toner transporting means, a toner metering charging means, and a development zone as illustrated in U.S. Pat. No. 4,394,429. The copy quality was excellent with complete, uniform solid area and lines, and the solid area density, measured by a densitometer, was 1.42.

The fusing properties of the above prepared toner were measured using a Xerox 5028™ fuser. Fusing conditions for the printing apparatus were varied to determine the minimum fix temperature behavior from developed images. Fusing evaluation by a standard image crease test was performed, and the minimum fix temperature of the toner was about 262° F. Generally, this low minimum fix temperature provides superior fusing results.

EXAMPLE II

A toner was formulated by melt mixing 86 percent by weight of the aforementioned extruded resin in Example I with 4 weight percent of LOTRYL® EMA HY6190™, 5 percent by weight of the polypropylene wax VISCOL 660P™, and 5 percent by weight of REGAL 330® carbon black from Cabot Inc. in a Werner & Pfleiderer ZSK-28 twin screw extruder at the same melt mixing conditions as Example I. LOTRYL® EMA HY6190™, available from Elf Atochem North America, Inc. of Pennsylvania, contained about 28 percent methyl acrylate in the copolymer composition and had molecular weight of about 20,000 to about 45,000. Subsequent to air drying, the resulting toner was pulverized as shown in Example I. Relative jetting rates were calculated from collection yields, and found to be about 1.38. This toner (3 lb. load) was subsequently blended with small-sized external additives, 0.5 weight percent TS-530, a hydrophobic treated fumed silica obtained from Cabot Corporation.

The toner powder flow index of the resulting toner was about 42 using a Hosokawa Powder tester. The free wax particles of this toner were determined, as described in Example I, to be less than our detection limit of 0.1 percent by weight for all toners prepared. Wax domain size was estimated, from TEM photo analysis, to be on average less than 1.1 micron in diameter with a standard deviation of 0.3 micron.

Subsequently, there was prepared a developer composition using the same method in Example I at a 3 percent toner concentration and wherein mixing was accomplished in a paint shaker for up to 60 minutes. The 60 minute paint-shaked toner showed only a small increase in percent cohesion from about 42 to about 63. Thereafter, the formulated developer composition was incorporated into an electrostatographic imaging device and the copy quality was judged excellent with complete, uniform solid area and lines, and the solid area density, measured by a densitometer, was 1.41.

The fusing properties of the above prepared toner were measured using the same method described in Example I, and the minimum fix temperature of the toner was about 258° F.

EXAMPLE III

A toner was formulated by melt mixing 86 percent by weight of the aforementioned extruded resin in Example I with 4 weight percent of LOTRYL® EMA 28MA400™, 5 percent by weight of the polypropylene wax VISCOL 660P™, and 5 percent by weight of REGAL 330™ carbon black from Cabot Inc. in a Werner & Pfleiderer ZSK-28 twin screw extruder at the same melt mixing conditions as Example I. LOTRYL® EMA 28MA400™, available from Elf Atochem North America, Inc. of Pennsylvania, contained about 28 percent methyl acrylate in the copolymer composition and had molecular weight of about 20,000 to about 50,000. Subsequent to air drying, the resulting toner was pulverized as shown in Example I. Relative jetting rates were calculated from collection yields, and found to be about 1.39. This toner (3 lb. load) was subsequently blended with small-sized external additives, 0.5 weight percent TS-530, a hydrophobic treated fumed silica obtained from Cabot Corporation.

The toner powder flow index of the resulting toner was about 47 using a Hosokawa Powder tester. The free wax particles of this toner were determined, as described in Example I, to be less than the detection limit of 0.1 percent by weight for all toners prepared. Wax domain size was estimated, from TEM photo analysis, to be on average less than 01.3 micron in diameter with a standard deviation of 0.4 micron.

Subsequently, there was prepared a developer composition using the same method as in Example I at a 3 percent toner concentration and wherein mixing was accomplished in a paint shaker for up to 60 minutes. The 60 minute paint-shaked toner showed only a small increase in percent cohesion from about 47 to about 65. Thereafter, the formulated developer composition was incorporated into an electrostatographic imaging device and the copy quality was judged excellent with complete, uniform solid area and lines, and the solid area density, measured by a densitometer, was 1.39.

The fusing properties of the above prepared toner were measured using the same method described in Example I, and the minimum fix temperature of the toner was about 263° F.

EXAMPLE IV

A toner was formulated by melt mixing 86 percent by weight of the aforementioned extruded resin in Example I with 4 weight percent of LOTRYL® EBA HY6210™, 5 percent by weight of the polypropylene wax VISCOL 660P®, and 5 percent by weight of REGAL 330™ carbon black from Cabot Inc. in a Werner & Pfleiderer ZSK-28 twin screw extruder at the same melt mixing conditions as Example I. LOTRYL® EBA HY6210™, available from Elf Atochem North America, Inc. of Pennsylvania, contained about 35 percent butyl acrylate and 65 percent of ethylene in the copolymer composition and had a molecular weight of about 30,000 to about 50,000. Subsequent to air drying, the resulting toner was pulverized as shown in Example I. Relative jetting rates were calculated from collection yields, and found to be about 1.45. This toner (3 lb. load) was subsequently blended with small-sized external additives, 0.5 weight percent TS-530, a hydrophobic treated fumed silica obtained from Cabot Corporation.

The toner powder flow index of the resulting toner was about 41 using a Hosokawa Powder tester. The free wax particles of this toner were determined, as described in Example I, to be about 0.12 percent by weight for all toners prepared. Wax domain size was estimated, from TEM photo analysis, to be on average less than 1.6 micron in diameter with a standard deviation of 0.4 micron.

Subsequently, there was prepared a developer composition using the same method in Example I at a 3 percent toner concentration and wherein mixing was accomplished in a paint shaker for up to 60 minutes. The 60 minute paint-shaked toner showed only a small increase in percent cohesion from about 41 to about 67. Thereafter, the formulated developer composition was incorporated into an electrostatographic imaging device and the copy quality was excellent with complete, uniform solid area and lines, and the solid area density, measured by a densitometer, was 1.45.

The fusing properties of the above prepared toner were measured using the same method described in Example I, and the minimum fix temperature of the toner was about 264° F.

Comparative Example I

There was prepared in an extrusion device, available as ZSK-40 from Werner Pfleiderer, a toner composition by adding to the extrusion device 90 percent by weight of an above-prepared crosslinked polyester resin with about 20 to 40 percent gel content, 5 percent by weight of REGAL 330® carbon black pigment, and 5 percent by weight of $_{660}$P™ Sanyo polypropylene wax. The product was then extruded at a rate of 20 pounds per hour, reaching a melt temperature of about 150° C. The melt product exiting from the extruder was cooled to about 25° C. on a belt and then crushed into small particles. Subsequent to air drying, the resulting toner was pulverized as illustrated in Example I. Relative jetting rates were calculated from collection yields, and found to be about 1.39. Thereafter, the aforementioned toner particles were classified in a Donaldson Model B classifier for the purpose of removing fines particles, that is, those with a volume median diameter of less than about, or equal to about 4 microns. The final volume median diameter of the toner after classification was 9.48 microns. This toner (3 lb. load) was subsequently blended with small-sized external additives 0.6 percent TS-530, a hydrophobic treated fumed silica obtained from Cabot Corporation at 2,740 RPM for 2 minutes with 80° F. jacket on Henschel 10 L FM-10 blender.

Using a Hosokawa Powder Tester instrument, a cohesion value of the above classified toner was 83.0. The percent by weight of the free wax particles was determined to be about 0.4 percent by weight for the toners prepared, using a centrifugal density separation technique. Wax domain size was estimated, from TEM photo analysis, to be on average, 6.0 microns in diameter with a standard deviation of 1.5 microns.

The formulated toner, 3 parts by weight, was mixed with 97 parts by weight of a carrier composition comprised of 99 percent by weight of an irregularly shaped steel core coated with 1 percent by weight of a Conductex SC Ultra conductive carbon black/poly (methylmethacrylate) composite), and wherein mixing was accomplished in a paint shaker for up to 60 minutes. There resulted on the toner composition, as determined in the known Faraday Cage apparatus, a negative triboelectric charge of 11 microcoulombs per gram after 60 minute paint shaking. The 60 minute paint-shaken toner evidenced an increase in percent cohesion, from 83 to 95, with 60 minute paint shaking. A cohesion value of less than about 75 is important for functional development in a xerographic environment. Thereafter, the formulated developer composition was incorporated into an electrostatographic imaging device and the copy quality was poor with incomplete, nonuniform solid area and nonuniform lines, and the solid area density, measured by a densitometer, was 0.9.

The fusing properties of the above prepared classified toner was measured using a Xerox 5028™ Fuser. Fusing conditions for the imaging device were varied so as to determine the minimum fix temperature behavior from the developed image. Fusing evaluation by a standard image crease test was performed, and the minimum fix temperature of the toner was found to be 289° F.

Comparative Example II

There was prepared a toner composition comprised of 87 percent by weight of a branched bisphenol A fumarate, polyester resin, where the estimated level of branched chains was between 5 and 40 percent, 4 percent by weight of the polypropylene wax VISCOL 660P™, available from Sanyo Chemicals of Japan, 5 percent by weight of REGAL 330® carbon black from Cabot Inc., and 4 percent by weight of HI-WAX 1140H styrene-modified polyethylene as the compatibilizer obtained from Mitsui Petrochemical Industries, Ltd. of Japan. The Hi-Wax was found to contain 40 mole percent of styrene units, or segments with 60 percent ethylene units, and was reported to have a molecular weight of 2,100 as measured by high-temperature GPC.

The toner product was extruded using a Werner & Pfleiderer ZSK-28 twin screw extruder at barrel set temperatures ranging from 90 to 120° C. at a throughput rate of 5 to 10 pounds/hour. The strands of melt mixed product exiting from the extruder were cooled by immersing them in a water bath maintained at room temperature, about 25° C. Subsequent to air drying, the resulting toner was pulverized as shown in Example I. Relative jetting rates were calculated from collection yields, and found to be about 1.1. This toner (3 lb. load) was subsequently blended with small-sized external additives, 0.5 weight percent TS-530, a hydrophobic treated fumed silica obtained from Cabot Corporation.

The toner powder flow index of the resulting toner was about 51 using a Hosokawa Powder tester. The percent by weight of the free wax particles was determined to be about 0.17 percent by weight using a centrifugal density separation technique. Wax domain size was estimated, from TEM photo analysis, to be on average 1.7 microns in diameter with a standard deviation of 0.8 micron.

Subsequently, there was prepared a developer composition by admixing the aforementioned formulated toner composition mechanically blended at 72° F. at a 3 percent toner concentration, that is 3.0 parts by weight of toner per 100 parts by weight of carrier comprised of a steel core, 90 microns diameter, with a coating, 0.8 weight percent thereover, of a polyvinylidine fluoride and polymethyl methacrylate. The 60 minute paint-shaked toner showed only a small increase in percent cohesion from about 51 to about 85. Thereafter, the formulated developer composition was incorporated into an electrostatographic imaging device and the copy quality was poor with incomplete, nonuniform solid area and nonuniform lines, and the solid area density, measured by a densitometer, was 1.0.

The fusing properties of the above prepared toner were measured using the same method described in Example I, and the minimum fix temperature of the toner was about 271° F.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of toner resin, colorant, wax, and an acrylatealkylene polymer compatibilizer.

2. A toner in accordance with claim 1 wherein the colorant is a pigment.

3. A toner in accordance with claim 1 wherein said acrylate alkylene polymer possesses from about 50 to about 2000 carbon atoms.

4. A toner in accordance with claim 1 wherein said acrylate alkylene polymer possesses from about 100 to about 1,000 carbon atoms.

5. A toner in accordance with claim 1 wherein said alkylene is ethylene.

6. A toner in accordance with claim 1 wherein the weight average molecular weight, $M_w$, of said compatibilizer is from about 10,000 to 160,000.

7. A toner in accordance with claim 1 wherein the weight average molecular weight, $M_w$, of said compatibilizer is from about 20,000 to 60,000.

8. A toner in accordance with claim 1 wherein the compatibilizer is an ethylene/butyl acrylate copolymer, an ethylene/methyl acrylate copolymer, an ethylene/methyl methacrylate copolymer, or an ethylene/butyl methacrylate copolymer.

9. A toner in accordance with claim 1 further containing a second crosslinked resin.

10. A toner in accordance with claim 9 wherein said crosslinked resin is a styrene acrylate, or a styrene methacrylate.

11. A toner composition in accordance with claim 1 wherein the wax and the compatibilizer together form domains of an average particle diameter of from about 0.1 to about 2 microns.

12. A toner composition in accordance with claim 1 wherein the compatibilizer is present in an amount of from about 0.5 to about 10 weight percent.

13. A toner composition in accordance with claim 2 wherein the compatibilizer is present in an amount of from about 1 to about 5 percent.

14. A toner composition in accordance with claim 1 wherein the resin is selected from the group consisting of polyesters, styrene butadiene copolymers, styrene diene copolymers, styrene polyolefin copolymers, styrene acrylate copolymers, and styrene methacrylate copolymers.

15. A toner composition in accordance with claim 14 wherein the polyester results from the condensation reaction of dimethylterephthalate, 1,2-propanediol, 1,3-butanediol, and pentaerythritol; or wherein the polyester results from the condensation reaction of proxylated-bisphenol A, dimethylterephthalate, 1,2-propanediol, diethylene glycol, and pentaerythritol.

16. A toner composition in accordance with claim 1 wherein said resin is present in an amount of from about 40 to about 90 weight percent, and further containing a second resin is present in an amount of from about 60 to about 10 weight percent.

17. A toner composition in accordance with claim 1 wherein said resin is comprised of styrene butadiene, styrene acrylate, or styrene methacrylate, and further containing a second crosslinked resin are comprised of a crosslinked polymer of styrene butadiene, styrene acrylate, or styrene methacrylate, wherein the first resin is present in an amount of from about 50 weight percent to about 85 weight percent, and the second resin is present in an amount of from about 10 weight percent to about 40 weight percent.

18. A toner composition in accordance with claim 1 wherein the colorant is the pigment carbon black, magnetite, magenta, cyan, yellow, or mixtures thereof.

19. A toner composition in accordance with claim 1 wherein the wax has a weight average molecular weight of from about 1,000 to about 20,000, wherein the wax is a polyolefin, or mixture of polyolefins, and wherein said wax is present in an amount of from about 1 to about 10 weight percent, and which toner further contains a charge enhancing additive selected from the group consisting of distearyl dimethyl ammonium methyl sulfate, a cetyl pyridinium halide, and stearyl phenethyl dimethyl ammonium tosylate, and wherein the polyolefin is polyethylene or polypropylene.

20. A developer composition comprised of the toner composition of claim 1, and carrier particles.

21. A method for obtaining images which comprises generating an electrostatic latent image on a photoconductive imaging member, subsequently affecting development of this image with the toner composition of claim 1, thereafter transferring the image to a permanent substrate, and optionally permanently affixing the image thereto.

22. A process for minimizing the amount of wax that escapes from a toner, which comprises melt mixing toner resin, colorant, a wax component, and an acrylate/alkylene polymer compatibilizer.

23. A process for minimizing the amount of wax that escapes from a toner which comprises melt mixing toner resin, colorant, a wax component, and a butylacrylate/ethylene copolymer compatibilizer.

24. A toner in accordance with claim 1 wherein alkylene is propylene, butylene, or mixtures thereof.

25. A toner composition consisting essentially of toner resin, colorant, wax, and an acrylatealkylene polymer compatibilizer.

26. A toner composition comprised of toner resin, colorant, wax, and an acrylatealkylene polymer compatibilizer, and wherein said resin is selected from the group consisting of polyesters, styrene butadiene copolymers, styrene diene copolymers, styrene polyolefin copolymers, styrene acrylate copolymers, and styrene methacrylate copolymers.

27. A toner in accordance with claim 26 wherein the compatibilizer is an ethylene/butyl acrylate copolymer, an ethylene/methyl acrylate copolymer, an ethylene/methyl methacrylate copolymer, or an ethylene/butyl methacrylate copolymer.

* * * * *